US011520285B2

(12) United States Patent
Iwasa et al.

(10) Patent No.: US 11,520,285 B2
(45) Date of Patent: Dec. 6, 2022

(54) DEVELOPING CARTRIDGE INCLUDING FIRST ARM PIVOTALLY MOVABLE ALONG WITH PIVOTAL MOVEMENT OF CAM AND ALONG WITH ROTATION OF FIRST SHAFT

(71) Applicant: BROTHER KOGYO KABUSHIKI KAISHA, Nagoya (JP)

(72) Inventors: Go Iwasa, Nagoya (JP); Yuwen Wang, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/379,135

(22) Filed: Jul. 19, 2021

(65) Prior Publication Data

US 2021/0341876 A1 Nov. 4, 2021

Related U.S. Application Data

(63) Continuation of application No. PCT/JP2020/005465, filed on Feb. 13, 2020.

(30) Foreign Application Priority Data

Mar. 28, 2019 (JP) ..... JP2019-063304

(51) Int. Cl.
*G03G 21/18* (2006.01)
*G03G 21/16* (2006.01)

(52) U.S. Cl.
CPC ..... *G03G 21/1857* (2013.01); *G03G 21/1647* (2013.01); *G03G 21/1676* (2013.01); *G03G 21/1821* (2013.01); *G03G 2221/1657* (2013.01)

(58) Field of Classification Search
CPC ..... G03G 21/1857; G03G 21/1647; G03G 21/1676; G03G 21/1821; G03G 2221/1657
See application file for complete search history.

(56) References Cited

U.S. PATENT DOCUMENTS

2006/0239716 A1 10/2006 Kim et al.
2006/0245785 A1* 11/2006 Kawamura ..... G03G 21/181 399/113

(Continued)

FOREIGN PATENT DOCUMENTS

JP 2006-301640 A 11/2006
JP 2011-059510 A 3/2011

(Continued)

OTHER PUBLICATIONS

International Search Report and Written Opinion issued in PCT/JP2020/005465, dated Mar. 31, 2020.

*Primary Examiner* — Sandra Brase
(74) *Attorney, Agent, or Firm* — Merchant & Gould P.C.

(57) ABSTRACT

A developing cartridge includes: a developing roller; a casing having an outer surface; a first shaft rotatable about a rotational axis; a first arm; and a cam. The first arm and the cam extend radially outward from an outer periphery of the first shaft and pivotally movable along with rotation of the first shaft. The cam has: one end connected to the first shaft; another end positioned farther from the rotational axis than the one end is farther from the rotational axis; and a pressure contact surface inclined so as to approach the outer surface of the casing as extending from the one end toward the another end. When a pressing force is applied to the pressure contact surface, the first arm pivotally moves from a first position to a second position along with: pivotal movement of the cam; and the rotation of the first shaft.

22 Claims, 9 Drawing Sheets

(56) References Cited

U.S. PATENT DOCUMENTS

| | | | | |
|---|---|---|---|---|
| 2011/0064457 | A1 | 3/2011 | Okabe et al. | |
| 2012/0014717 | A1* | 1/2012 | Sugiyama | G03G 15/0121 399/228 |
| 2016/0161899 | A1* | 6/2016 | Noguchi | G03G 21/1821 399/101 |
| 2018/0074454 | A1 | 3/2018 | Uneme et al. | |
| 2018/0181056 | A1 | 6/2018 | Itabashi | |

FOREIGN PATENT DOCUMENTS

| | | | |
|---|---|---|---|
| JP | 2013-054183 | A | 3/2013 |
| JP | 2017-003974 | A | 1/2017 |
| JP | 2018-109659 | A | 7/2018 |
| JP | 2019-045580 | A | 3/2019 |

* cited by examiner

DEVELOPING CARTRIDGE INCLUDING FIRST ARM PIVOTALLY MOVABLE ALONG WITH PIVOTAL MOVEMENT OF CAM AND ALONG WITH ROTATION OF FIRST SHAFT

CROSS REFERENCE TO RELATED APPLICATION

This is a by-pass continuation application of International Application No. PCT/JP2020/005465 filed Feb. 13, 2020 claiming priority from Japanese Patent Application No. 2019-063304 filed Mar. 28, 2019. The entire contents of the International Application and the priority application are incorporated herein by reference.

TECHNICAL FIELD

The present disclosure relates to a developing cartridge.

BACKGROUND

Conventionally, there has been known an electro-photographic type image forming apparatus such as a laser printer and an LED printer. The image forming apparatus includes a developing cartridge. The developing cartridge includes a developing roller for supplying developing agent. One conventional image forming apparatus is described in a prior art, for example. The image forming apparatus described in the prior art includes a drum cartridge including a photosensitive drum. The developing cartridge is attachable to the drum cartridge. Upon attachment of the developing cartridge to the drum cartridge, the photosensitive drum and the developing roller are brought into contact with each other.

SUMMARY

The image forming apparatus disclosed in the prior art is switchable between a state where the developing roller and the photosensitive drum are in contact with each other and a state where the developing roller and the photosensitive drum are separated from each other. In the image forming apparatus disclosed in the prior art, components for moving the developing cartridge to separate the developing roller from the photosensitive drum are provided at each side of the drum cartridge. The components at each side need to receive a driving force from a main body of the image forming apparatus.

In view of the foregoing, it is an object of the present disclosure to provide a developing cartridge capable of moving a developing roller away from a photosensitive drum due to a driving force applied to only one side without necessitating application of a driving force to both sides.

In order to attain the above and other objects, according to one aspect, the present disclosure provides a developing cartridge including: a developing roller; a casing; a first shaft; a first arm; and a cam. The developing roller is rotatable about a developing roller-axis extending in a first direction. The casing is configured to accommodate developing agent therein. The casing has an outer surface positioned at one end portion in the first direction of the casing. The first shaft is positioned at the outer surface of the casing and rotatable about a rotational axis extending in the first direction. The first shaft has an outer periphery. The first arm extends radially outward from the outer periphery of the first shaft. The first arm is pivotally movable about the rotational axis along with rotation of the first shaft. The cam extends radially outward from the outer periphery of the first shaft in a direction different from a direction in which the first arm extends. The cam is pivotally movable about the rotational axis along with the rotation of the first shaft. The cam has: one end; another end; and a pressure contact surface. The one end is connected to the first shaft. The another end is positioned farther from the rotational axis than the one end is farther from the rotational axis. The pressure contact surface is inclined so as to approach the outer surface of the casing as extending from the one end toward the another end. When a pressing force is applied to the pressure contact surface, the first arm pivotally moves from a first position to a second position along with pivotal movement of the cam and along with the rotation of the first shaft.

BRIEF DESCRIPTION OF THE DRAWINGS

The particular features and advantages of the embodiment (s) as well as other objects will become apparent from the following description taken in connection with the accompanying drawings, in which.

DETAILED DESCRIPTION

Hereinafter, one embodiment of the present disclosure will be described while referring to the accompanying drawings.

In the following description, a direction in which a rotational axis of a developing roller (a developing roller-axis) extends will be referred to as "first direction". Here, an outer circumferential surface of the developing roller includes a portion exposed to the outside of a casing, and another portion positioned inside the casing. A direction in which the portion of the circumferential surface of the developing roller and the other portion of the circumferential surface of the developing roller are arrayed will be referred to as "second direction". The first direction and the second direction cross each other. Preferably, the first direction and the second direction are perpendicular to each other. Further, a direction crossing both the first direction and the second direction will be referred to as "third direction". Preferably, the third direction is perpendicular to both the first direction and the second direction.

<1. Overall Configuration of Image Forming Apparatus>

Figure 1:
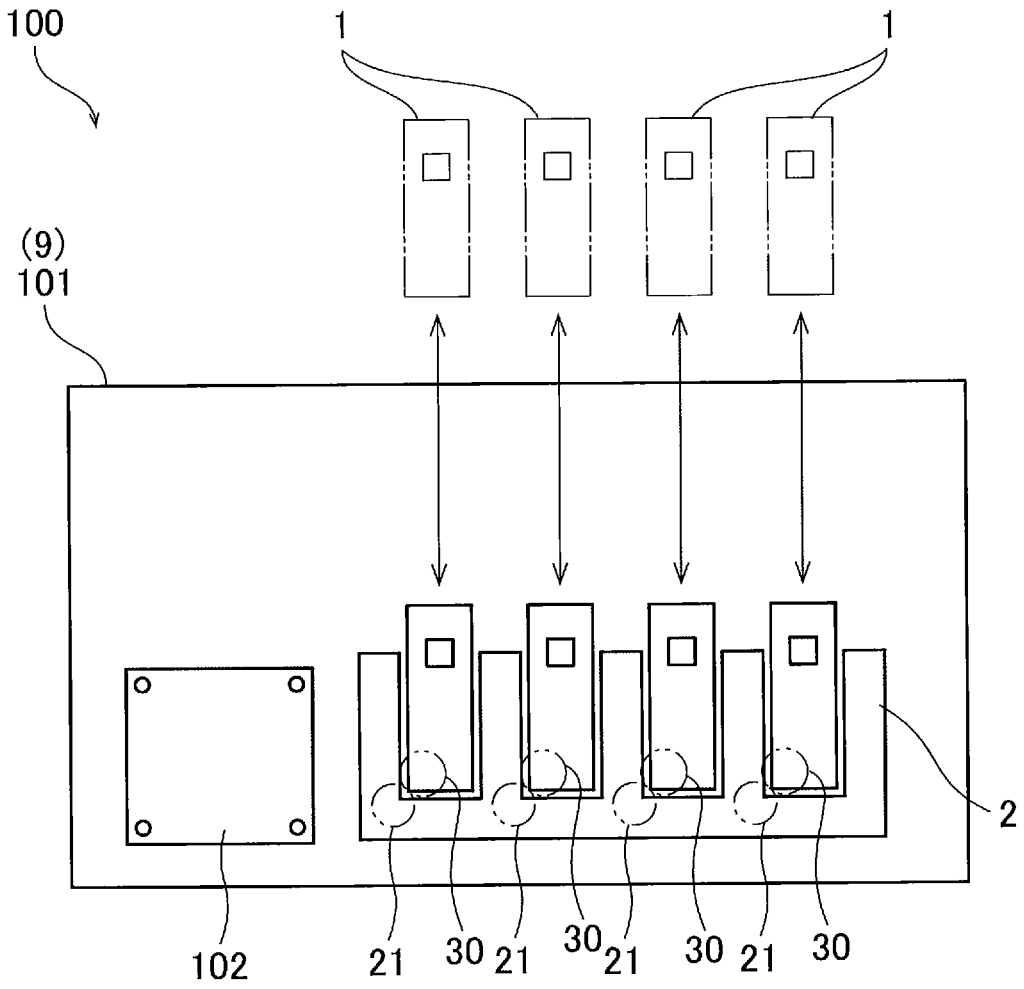
FIG. 1 is a schematic diagram of an image forming apparatus including a developing cartridge according to one embodiment of the present disclosure.

FIG. 1 is a schematic diagram of an image forming apparatus 100. The image forming apparatus 100 is an electro-photographic type printer such as a laser printer and an LED printer. As illustrated in FIG. 1, the image forming apparatus 100 includes four developing cartridges 1, a drum cartridge 2, and a main body portion 9.

<1-1. Overall Configuration of Main Body Portion>

Hereinafter, an overall configuration of the main body portion 9 will be described. The main body portion 9 includes a main frame 101, a transfer belt (not illustrated), and a controller 102.

The main frame 101 has a generally rectangular-parallelepiped shape, and has an internal space. The drum cartridge 2 to which the developing cartridges 1 are attached can be accommodated in the internal space of the main frame 101. Further, four chargers (not illustrated), four light sources (not illustrated), the transfer belt, and the controller 102 are provided in the main frame 101.

The transfer belt is an endless belt for conveying printing sheets. The transfer belt is positioned opposite to developing rollers 30 with respect to photosensitive drums 21 of the drum cartridge 2 in a state where the drum cartridge 2 to which the developing cartridges 1 are attached is positioned in the internal space of the main frame 101. The transfer belt has an outer peripheral surface capable of contacting outer circumferential surfaces of the photosensitive drums 21.

The controller 102 includes a processor such as CPU, and a main body memory. The main body memory is a storage medium from which information is readable and to which information is writable. For example, the main body memory is a flash ROM or an EEPROM. The main body memory stores therein computer programs for controlling operations performed in the image forming apparatus 100. The processor is configured to execute various processing in accordance with the computer programs stored in the main body memory. That is, the processor is configured to execute various printing process and other processes associated therewith to be performed in the image forming apparatus 100.

<1-2. Overall Configurations of Developing Cartridges>

Figure 2:
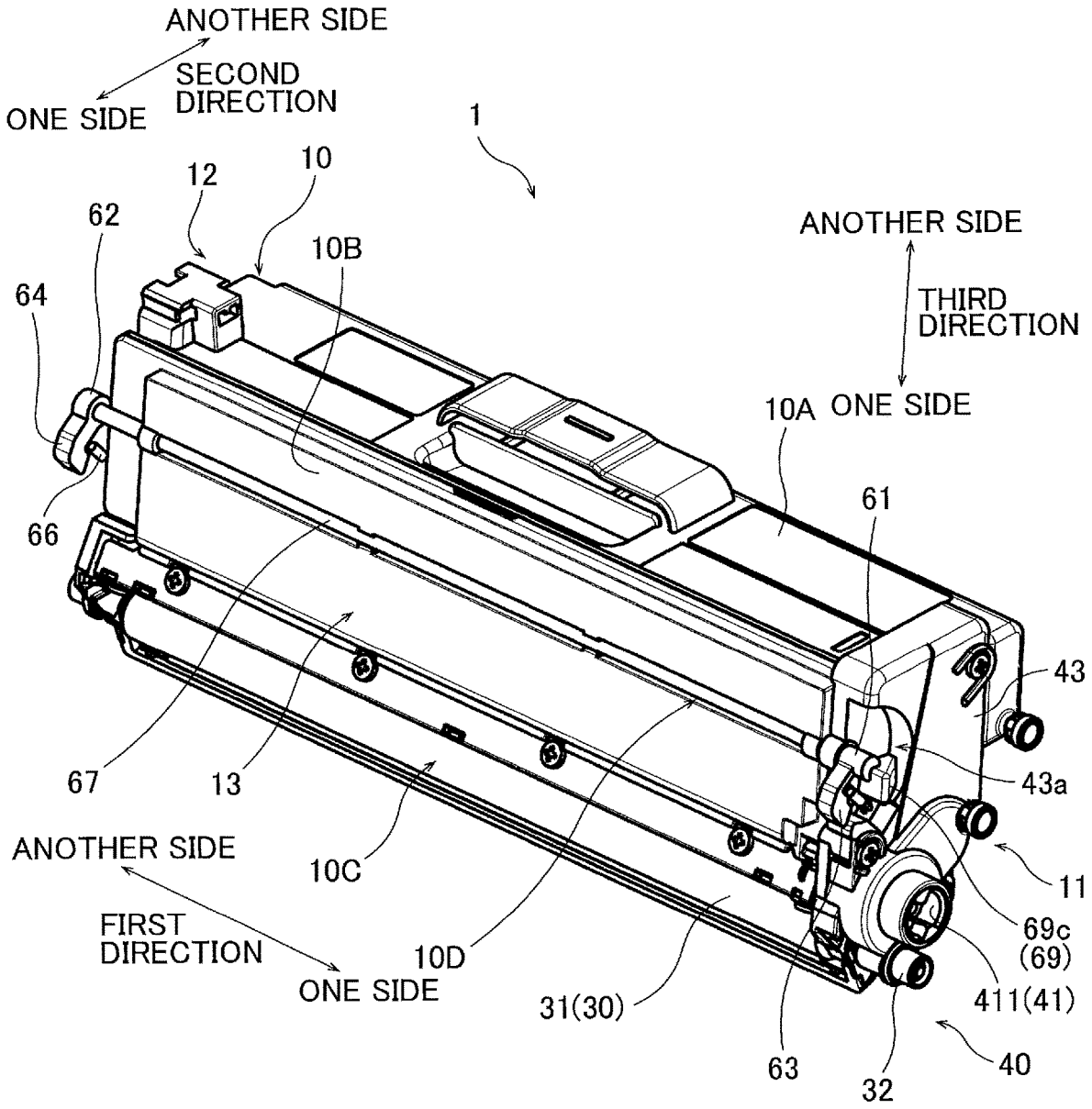
FIG. 2 is a perspective view of the developing cartridge according to the embodiment.

Hereinafter, overall configurations of the developing cartridges 1 will be described. FIG. 2 is a perspective view of the developing cartridge 1.

As illustrated in FIG. 1, the developing cartridges 1 are attachable to and detachable from a frame 200 of the drum cartridge 2. As illustrated in FIG. 2, each of the developing cartridges 1 includes a casing 10 configured to accommodate developing agent therein. The casing 10 includes a container 10A and a lid 10B (an example of a frame). The container 10A has an internal space. The lid 10B has a flat plate shape. The lid 10B is positioned at one end portion in the second direction of the casing 10 to cover an opening formed at one end portion in the second direction of the container 10A. Further, the lid 10B has a third outer surface 13 (described later). In the meantime, the container 10A further has an opening portion 10C at one end portion in the third direction thereof. The developing roller 30 (described later) is positioned in the opening portion 10C.

The casing 10 has a first outer surface 11 and a second outer surface 12 those are spaced away from each other in the first direction. The first outer surface 11 is positioned at one end portion in the first direction of the casing 10, whereas the second outer surface 12 is positioned at another end portion in the first direction of the casing 10. The casing 10 further has the third outer surface 13 and a fourth outer surface those are spaced away from each other in the second direction. The third outer surface 13 is positioned at one end portion in the second direction of the casing 10, and the fourth outer surface is positioned at another end portion in the second direction of the casing 10.

The four developing cartridges 1 accommodate therein toners of colors different from one another (for example, cyan, magenta, yellow and black). However, the developing cartridges 1 may accommodate therein toner of the same color.

Each of the developing cartridges 1 includes the developing roller 30 having a cylindrical shape. The developing roller 30 is rotatable about a developing roller-axis which is a rotational axis extending in the first direction. The developing roller 30 is supported by the casing 10 so as to be rotatable about the developing roller-axis.

The developing roller 30 includes a developing roller body 31 and a developing roller shaft 32. The developing roller body 31 has a hollow cylindrical shape and extends in the first direction. The developing roller body 31 is made of material having elasticity such as rubber. The developing roller shaft 32 is a solid cylindrical member that penetrates the developing roller body 31 in the first direction. The developing roller shaft 32 is made of metal or electrically conductive resin.

The developing roller body 31 is fixed to the developing roller shaft 32 so that relative rotation of the developing roller body 31 with respect to the developing roller shaft 32 is prevented. That is, the developing roller body 31 is rotatable together with the developing roller shaft 32 about the developing roller-axis. An outer circumferential surface of the developing roller body 31 having one end portion in the second direction exposed to an outside of the casing 10 through the opening portion 10C. Another end portion in the second direction of the outer circumferential surface of the developing roller body 31 is positioned inside the casing 10.

A developing roller gear (not illustrated) is coupled to one end portion in the first direction of the developing roller shaft 32. The developing roller gear is positioned at the first outer surface 11. The developing roller gear is fixed to the developing roller shaft 32 so that relative rotation between the developing roller gear and the developing roller shaft 32 is prevented. Hence, rotation of the developing roller gear causes rotation of the developing roller shaft 32 at the same rotational speed to rotate the developing roller body 31 together with the developing roller shaft 32.

Incidentally, the developing roller shaft 32 may not penetrate the developing roller body 31 in the first direction. For example, two developing roller shafts 32 may extend in the first direction from both ends in the first direction of the developing roller body 31, respectively.

As illustrated in FIG. 2, the developing cartridge 1 includes a gear portion 40. The gear portion 40 is positioned at the first outer surface 11 of the casing 10. The gear portion 40 includes the developing roller gear described above, a coupling 41, and a gear cover 43.

The coupling 41 is a rotary member configured to receive a driving force supplied from a power source of the image forming apparatus 100. The coupling 41 is rotatable about a rotational axis extending in the first direction. The coupling 41 has a fixing hole 411 recessed in the first direction. Upon attachment of the drum cartridge 2 to which the developing cartridges 1 are attached to the main body portion 9 of the image forming apparatus 100, a transmission shaft (not illustrated) of the main body portion 9 is inserted into the fixing hole 411. As a result, the transmission shaft and the coupling 41 are coupled to each other so as not to rotate relative to each other. Accordingly, rotation of the transmission shaft causes rotation of the coupling 41, which causes rotation of the developing roller gear together with the developing roller 30. Further, rotation of the coupling 41 also causes rotations of a supply roller (not illustrated) and an agitator (not illustrated).

<1-3. Overall Configuration of Drum Cartridge>

Figure 3:
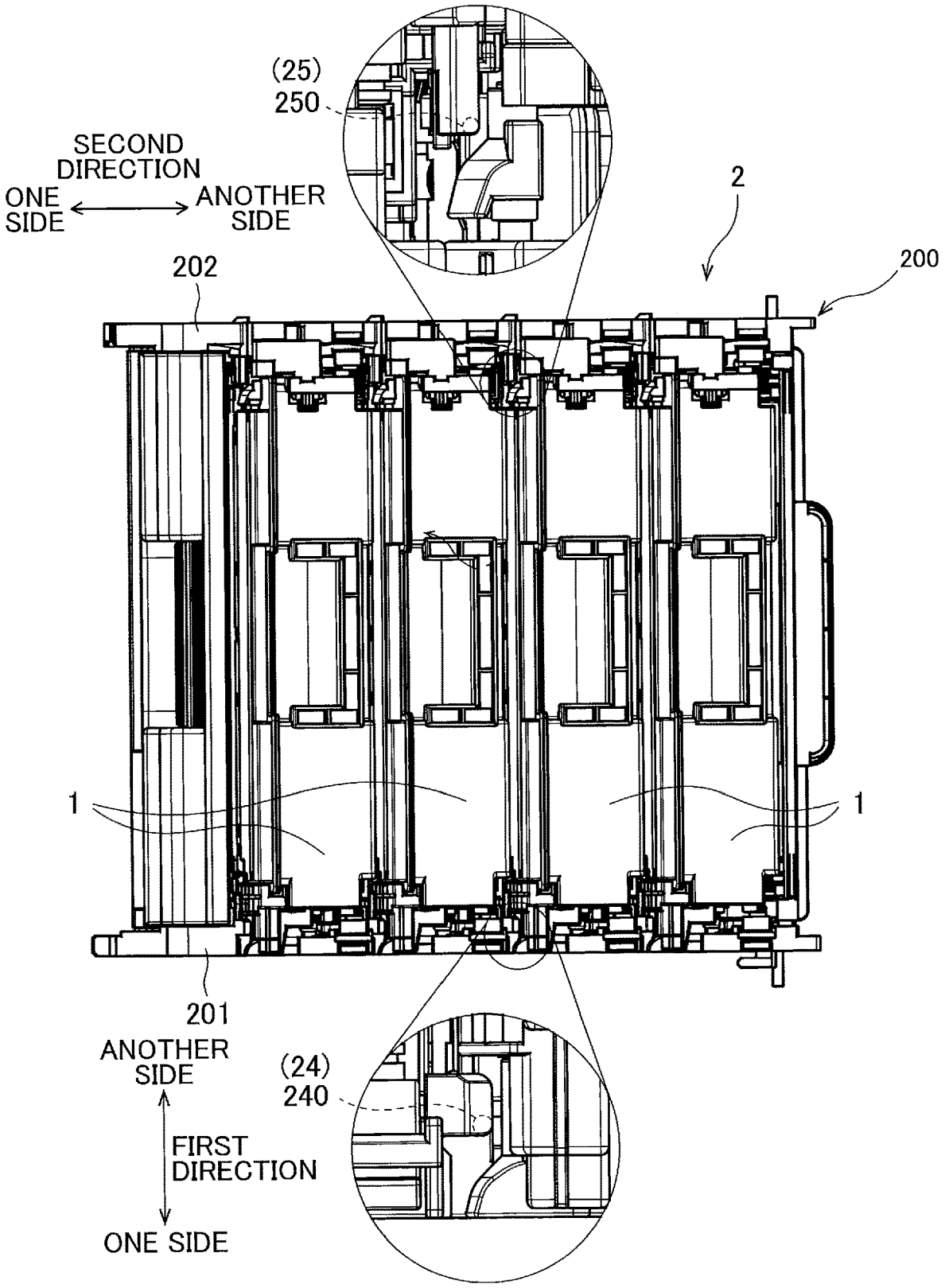
FIG. 3 is a view of a drum cartridge to which the developing cartridge according to the embodiment is attached as viewed in a third direction from another side toward the one side.

Next, an overall configuration of the drum cartridge 2 will be described. FIG. 3 is a view of the drum cartridge 2 to which the developing cartridges 1 are attached as viewed in the third direction from another side toward one side. As illustrated in FIGS. 1 and 3, the drum cartridge 2 includes the four photosensitive drums 21, and the frame 200.

Each of the four photosensitive drums 21 illustrated in FIG. 1 has an outer circumferential surface having a cylindrical shape centered on a drum axis, which is a rotational axis extending in the first direction. The outer circumferential surface of each photosensitive drum 21 is coated with photosensitive material. Each of the photosensitive drums 21 is rotatable about its drum axis.

The frame 200 is a frame that supports the four photosensitive drums 21 such that the four photosensitive drums 21 are arranged to be spaced from one another in the second direction. The frame 200 includes a pair of side frames 201 and 202 facing each other in the first direction. The side frame 202 is positioned further in the first direction from the one side toward the other side than the side frame 201. The photosensitive drums 21 are rotatably supported by the side frames 201 and 202.

When performing a printing process in the image forming apparatus 100, the controller 102 drives a motor (not illustrated). As the motor is driven, the photosensitive drum 21 and the developing roller 30 receive a driving force from the motor through the transmission shaft and the coupling 41 to rotate. Further, the controller 102 supplies electric power to each charger (not illustrated) to charge the outer circumferential surface of the corresponding photosensitive drum 21. Further, the controller 102 turns on each light source (not illustrated) so that the light source emits light onto the outer circumferential surface of the corresponding photosensitive drum 21. Accordingly, an electrostatic latent image corresponding to an image to be printed is formed on the outer circumferential surface of the photosensitive drum 21.

The toner accommodated in the developing cartridge 1 is supplied through the developing roller 30 to the electrostatic latent image formed on the photosensitive drum 21. As a result, the electrostatic latent image becomes a visible toner image on the outer circumferential surface of the photosensitive drum 21. In the meantime, a printing sheet is conveyed to a portion between the photosensitive drum 21 and the transfer belt. Hence, the toner image is transferred from the outer circumferential surface of the photosensitive drum 21 to the printing sheet. The printing sheet carrying the toner image thereon is then conveyed to a fixing unit (not illustrated) provided in the image forming apparatus 100 where the toner image is thermally fixed to the printing sheet. As a result, an image is printed on the printing sheet.

In the image forming apparatus 100, it is preferable that each of the developing rollers 30 be separated from the corresponding one of the photosensitive drums 21 in order to change colors for printing or during a standby period. To this end, the image forming apparatus 100 in the present embodiment provides a contacting state and separated state. In the contacting state of the image forming apparatus 100, the developing rollers 30 and the corresponding photosensitive drums 21 are in contact with each other in a state where the developing cartridges 1 are attached to the drum cartridge 2. In the separated state of the image forming apparatus 100, the developing rollers 30 and the corresponding photosensitive drums 21 are separated from each other in the state where the developing cartridges 1 are attached the drum cartridge 2.

To this effect, as components for realizing the contact and the separation between the developing rollers 30 and the corresponding photosensitive drums 21, each of the developing cartridges 1 further includes a first shaft 61, a first arm 63, a cam 69, a first elastic member 65, a connection bar 67, a second shaft 62, a second arm 64, and a second elastic member 66. Also, as components for realizing the contact and the separation, the drum cartridge 2 further includes first guide rollers 24 and second guide rollers 25. Still also, as components for realizing the contact and the separation, the main body portion 9 includes drive shafts 103.

<2. Components in Drum Cartridge for Performing Contact and Separation>

Figure 4:
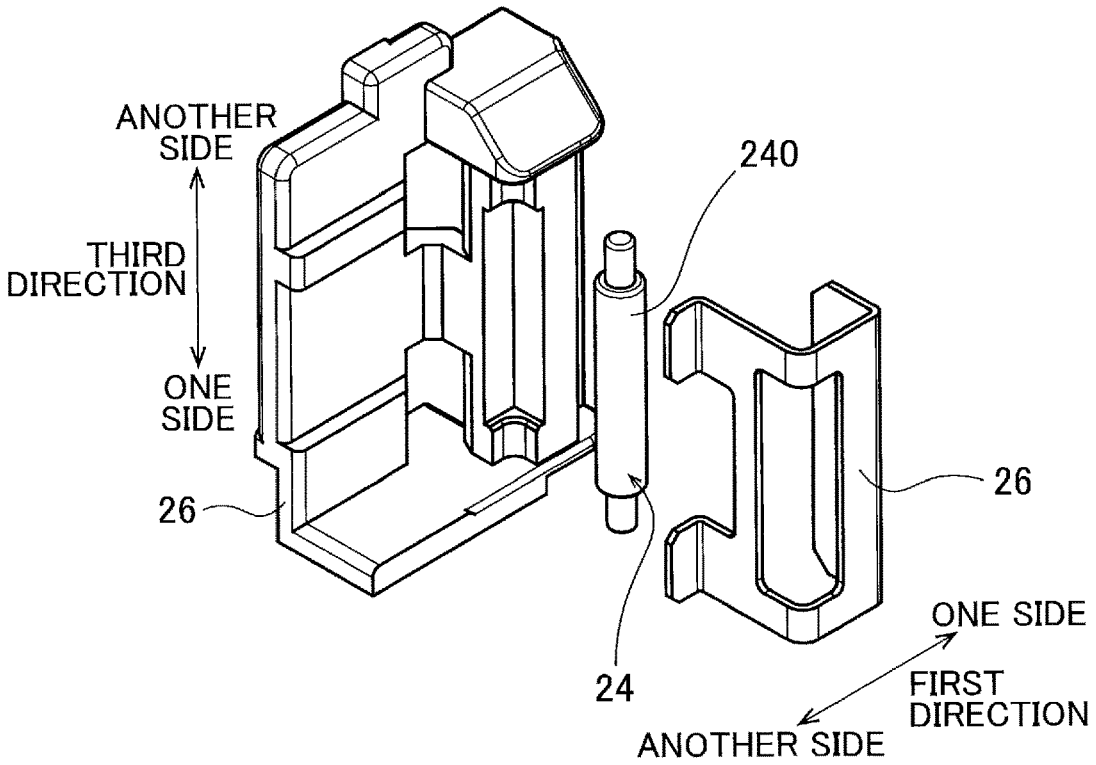
FIG. 4 is a perspective view of a first guide roller and a bearing that supports the first guide roller of the drum cartridge.
Figure 5:
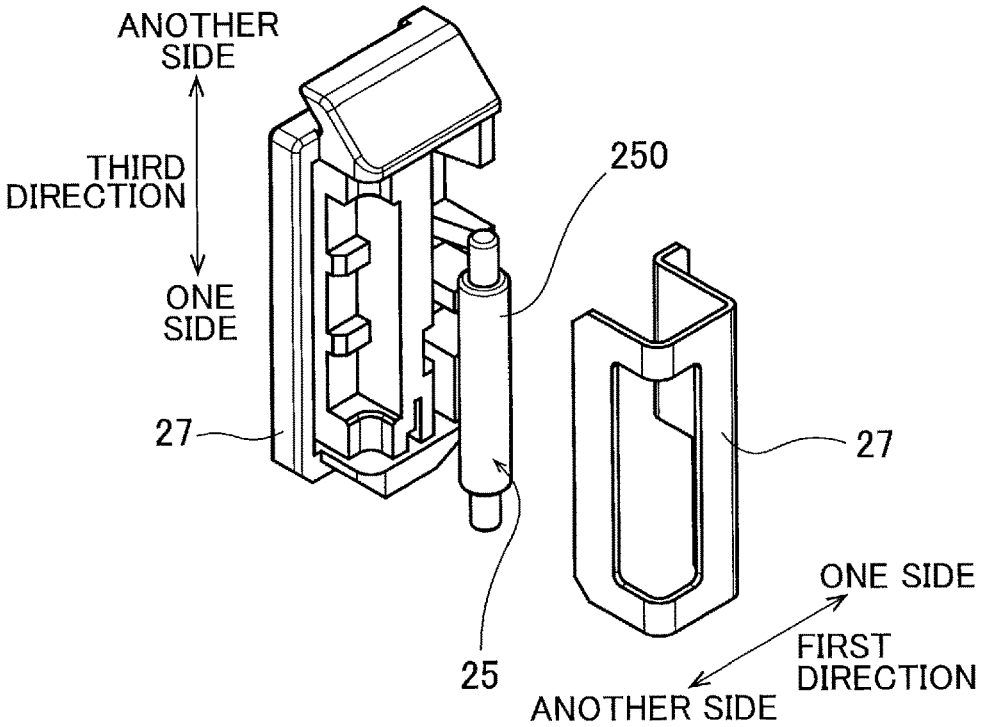
FIG. 5 is a perspective view of a second guide roller and a bearing that supports the second guide roller of the drum cartridge.

Hereinafter, components of the drum cartridge 2 for performing the contact and the separation between the developing rollers 30 and the corresponding photosensitive drums 21 will be described with reference to FIGS. 3 to 5. FIG. 4 is a perspective view of the first guide roller 24. FIG. 5 is a perspective view of the second guide roller 25.

In the state where the developing cartridges 1 are attached to the drum cartridge 2, the first outer surfaces 11 of the developing cartridges 1 face an inner surface of the side frame 201 in the first direction. Similarly, in the state where the developing cartridges 1 are attached to the drum cartridge 2, the second outer surfaces 12 of the developing cartridges 1 face an inner surface of the side frame 202 in the first direction.

As indicated by a broken line in a partial enlarged view in FIG. 3, the side frame 201 includes the first guide rollers 24. That is, the first guide rollers 24 are positioned at one end portion in the first direction of the frame 200.

FIG. 4 is an exploded perspective view of the first guide roller 24 and a bearing 26 that holds the first guide roller 24. As illustrated in FIG. 4, the first guide roller 24 has an outer circumferential surface 240 (contact surface) having a cylindrical shape extending in the third direction. The first guide roller 24 has one end portion and another end portion in the third direction each rotatably supported by the bearing 26. With this configuration, the first guide roller 24 is rotatable about a central axis extending in the third direction.

As indicated by a broken line in another partial enlarged view in FIG. 3, the side frame 202 includes the second guide rollers 25. That is, the second guide rollers 25 are positioned at another end portion in the first direction of the frame 200.

FIG. 5 is an exploded perspective view of the second guide roller 25 and a bearing 27 that holds the second guide roller 25. As illustrated in FIG. 5, the second guide roller 25 has an outer circumferential surface 250 (contact surface) having a cylindrical shape extending in the third direction. The second guide roller 25 has one end portion and another end portion in the third direction each rotatably supported by the bearing 27. With this configuration, the second guide roller 25 is rotatable about a central axis extending in the third direction.

Each of the first guide rollers 24 and corresponding each of the second guide rollers 25 are arranged in the first direction as a pair. As will be described later, components in the developing cartridge 1 for performing the contact and the separation between the developing rollers 30 and the corresponding photosensitive drums 21 are capable of contacting the first guide roller 24 and the second guide roller 25.

<3. Components in Main Body Portion for Performing Contact and Separation>

Hereinafter, components of the main body portion 9 for performing the contact and the separation between the developing rollers 30 and the corresponding photosensitive drums 21 will be described. The main body portion 9 includes the drive shafts 103 as illustrated in FIGS. 7 to 10. Each of the drive shafts 103 has one of a solid cylindrical shape and a solid prismatic columnar shape extending in the first direction. Each of the drive shafts 103 is movable in the first direction between an advanced position and a retracted position upon receiving a driving force from a power source of the main body portion 9.

<4. Components in Developing Cartridges for Performing Contact and Separation>

Figure 6:
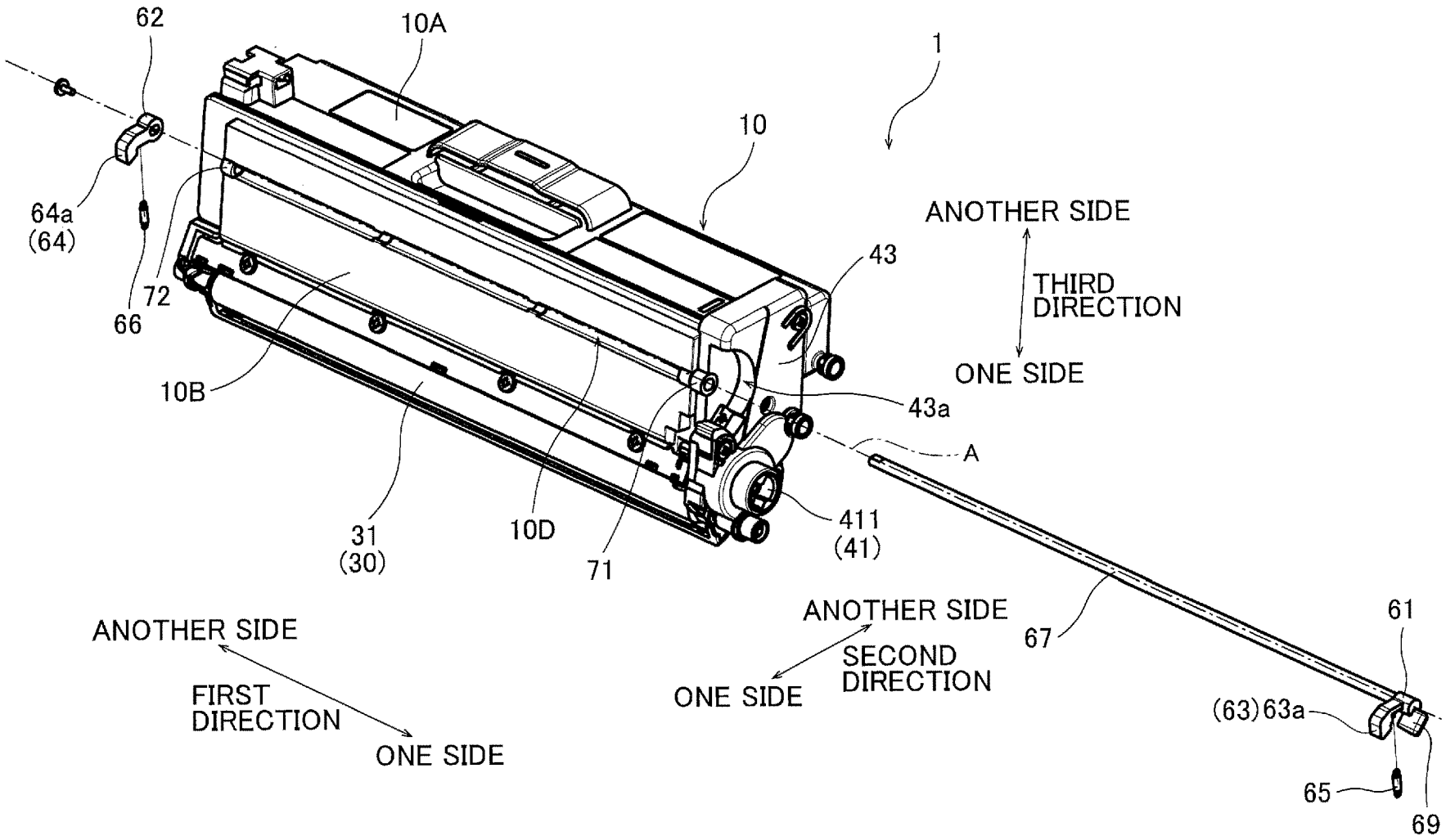
FIG. 6 is a perspective view of the developing cartridge according to the embodiment in which a portion thereof is exploded.

Hereinafter, components of the developing cartridges 1 for performing the contact and the separation between the developing rollers 30 and the photosensitive drums 21 will be described with reference to FIGS. 6 to 10. FIG. 6 is a perspective view of the developing cartridge 1 in which a portion thereof is exploded.

The first shaft 61 illustrated in FIG. 6 is cylindrical in shape. The first shaft 61 is positioned at the first outer surface 11 which is positioned at the one end in the first direction of the casing 10. Specifically, the gear cover 43 positioned at the first outer surface 11 of the casing 10 has a notch 43*a* which is open toward one end portion in the second direction of the gear cover 43. The first shaft 61 is positioned inside the notch 43*a*. The first shaft 61 is rotatable about a rotational axis A extending in the first direction.

The first arm 63 extends radially outward from an outer periphery of the first shaft 61. That is, the first arm 63 has a base end portion fixed to the outer periphery of the first shaft 61, and a distal end portion positioned away from the first shaft 61 in a radial direction of the first shaft 61. The first arm 63 has a plate-like shape extending perpendicularly to the first direction. The distal end portion of the first arm 63 has a flat surface 63*a* that extends in parallel to the first direction. The first arm 63 is pivotally movable about the rotational axis A along with rotation of the first shaft 61. The first arm 63 is positioned inside the notch 43*a* of the gear cover 43.

Figure 7:
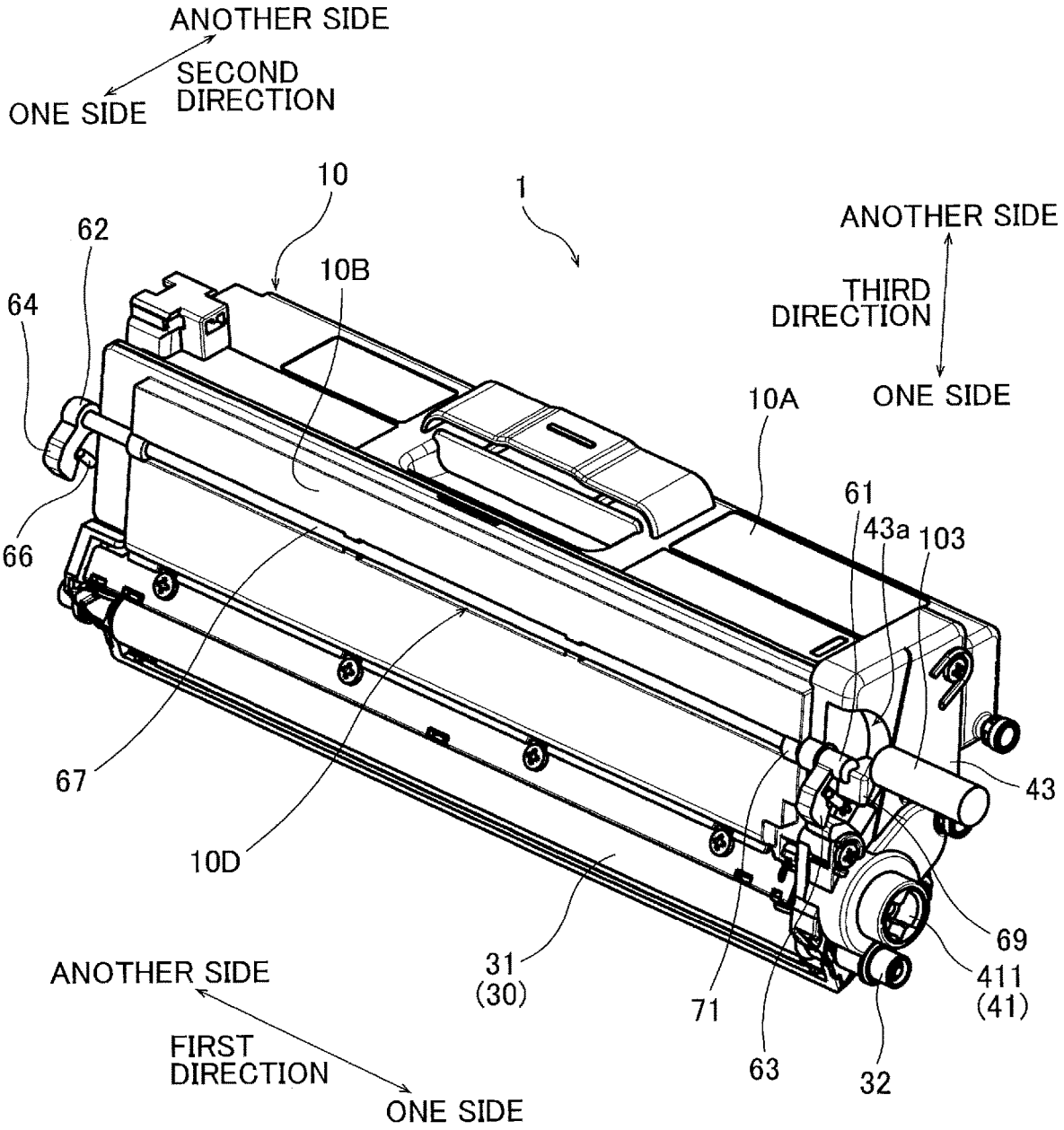
FIG. 7 is a perspective view of the developing cartridge according to the embodiment in a contacting state of the image forming apparatus.
Figure 8:
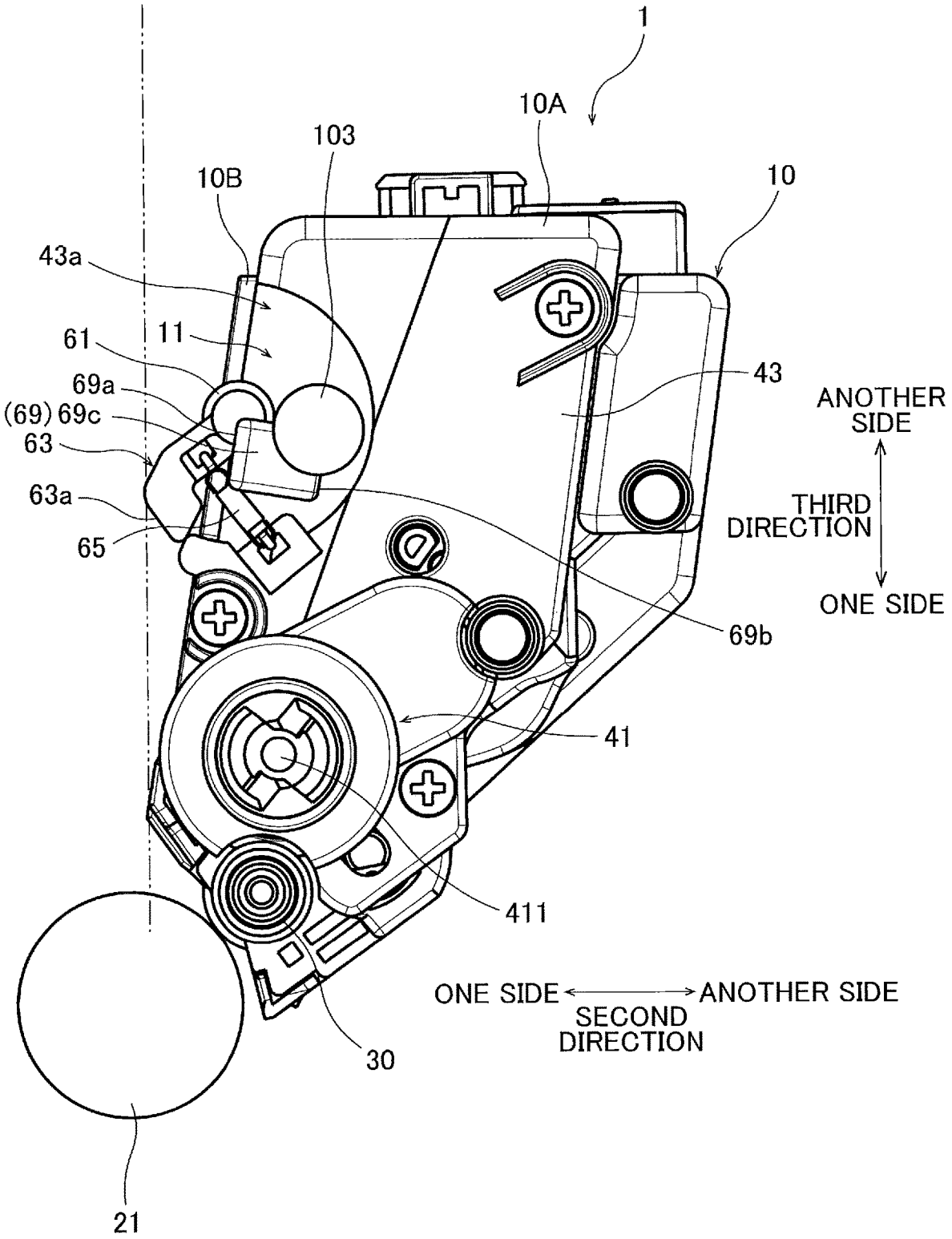
FIG. 8 is a view of the developing cartridge according to the embodiment and a photosensitive drum of the drum cartridge in the contacting state of the image forming apparatus as viewed in the first direction from one side toward another side.

As illustrated in FIGS. 6 through 8, the cam 69 extends radially outward from the outer periphery of the first shaft 61. The cam 69 has one end 69*a*, another end 69*b*, and a pressure contact surface 69*c*. The one end 69*a* is connected (fixed) to the first shaft 61. The other end 69*b* is positioned farther from the rotational axis A than the one end 69*a* is from the rotational axis A. The cam 69 extends in a direction different from a direction in which the first arm 63 extends. The cam 69 is pivotally movable about the rotational axis A along with the rotation of the first shaft 61. The cam 69 is positioned inside the notch 43*a* of the gear cover 43.

The pressure contact surface 69*c* of the cam 69 is inclined so as to approach the first outer surface 11 of the casing 10 as extending from the one end 69*a* to the other end 69*b* of the cam 69. Particularly, the pressure contact surface 69*c* is inclined so as to approach the first outer surface 11 as extending away from the first arm 63 in the present embodiment.

The first arm 63 is pivotally movable from a first position (see FIG. 8) to a second position (see FIG. 10) along with the rotation of the first shaft 61 and along with pivotal movement of the cam 69. As will be described later, a protruding amount of the first arm 63 from the third outer surface 13 in the second position of the first arm 63 is greater than a protruding amount of the first arm 63 from the third outer surface 13 in the first position of the first arm 63.

The first elastic member 65 is a tension coil spring in the present embodiment. The first elastic member 65 urges the first arm 63 in a direction from the second position to the first position. The first elastic member 65 has one end connected to an intermediate portion of the first arm 63 which is a portion of the first arm 63 between the base end portion and the distal end portion thereof. Also, the first elastic member 65 has another end connected to an inner edge of the notch 43*a*.

The second shaft 62 is a member having a cylindrical shape. The second shaft 62 is positioned at the second outer surface 12 which is positioned at the other end portion in the first direction of the casing 10. The second shaft 62 is rotatable about the rotational axis A along with the rotation of the first shaft 61.

As illustrated in FIG. 6, the second arm 64 extends radially outward from an outer periphery of the second shaft 62. The second arm 64 has a base end portion fixed to the outer periphery of the second shaft 62. The second arm 64 has a distal end portion positioned away from the second shaft 62 in a radial direction of the second shaft 62. The second arm 64 has a plate-like shape extending perpendicularly to the first direction. The distal end portion of the second arm 64 has a flat surface 64*a* extending in parallel to the first direction. The second arm 64 is pivotally movable about the rotational axis A along with rotation of the second shaft 62. The second arm 64 has a shape and a size identical to those of the first arm 63.

The connection bar 67 has one of a solid cylindrical shape and a solid prismatic columnar shape extending in the first direction. The connection bar 67 connects the first shaft 61 and the second shaft 62 to each other. The connection bar 67 is positioned between the first shaft 61 and the second shaft 62 in the first direction. The connection bar 67 is rotatable about the rotational axis A along with the rotation of the first shaft 61 and the second shaft 62. In the present embodiment, the first shaft 61 is fixed to one end in the first direction of the connection bar 67, and the second shaft 62 is fixed to another end in the first direction of the connection bar 67.

In the present embodiment, the connection bar 67 is rotatably supported by the third outer surface 13 of the casing 10. Specifically, the lid 10B having a flat plate shape has the third outer surface 13 of the casing 10. The lid 10B has a groove 10D extending in the first direction. At least a portion of the connection bar 67 is positioned inside the groove 10D.

The groove 10D has one end portion and another end portion in the first direction. A first ring 71 having a circular annular shape is positioned at the one end portion in the first direction of the lid 10B, whereas a second ring 72 having a circular annular shape is positioned at the other end portion in the first direction of the groove 10D. The connection bar 67 is inserted through the first ring 71 and the second ring 72, whereby disengagement of the connection bar 67 from the groove 10D can be avoided.

The second arm 64 is pivotally movable from a third position (see FIG. 7) to a fourth position (see FIG. 9) along with the rotation of the second shaft 62. The third position of the second arm 64 is a position that corresponds to the first position of the first arm 63, and the fourth position of the second arm 64 is a position that corresponds to the second position of the first arm 63. As will be described later, a protruding amount of the second arm 64 from the third outer surface 13 in the fourth position of the second arm 64 is greater than a protruding amount of the second arm 64 from the third outer surface 13 in the third position of the second arm 64.

The second elastic member 66 is a tension coil spring in the present embodiment. The second elastic member 66 urges the second arm 64 in a direction from the fourth position toward the third position. The second elastic member 66 has one end connected to an intermediate portion of the second arm 64 which is a portion of the second arm 64 between the base end portion and the distal end portion thereof. The second elastic member 66 further has another end connected to the second outer surface 12 of the casing 10.

<5. Movement of Each Component at the Time of Switching Between Contacting State and Separated State>

Hereinafter, how each component operates for realizing switching between the contact and the separation will be described with reference to FIGS. 7 to 10.

Figure 9:
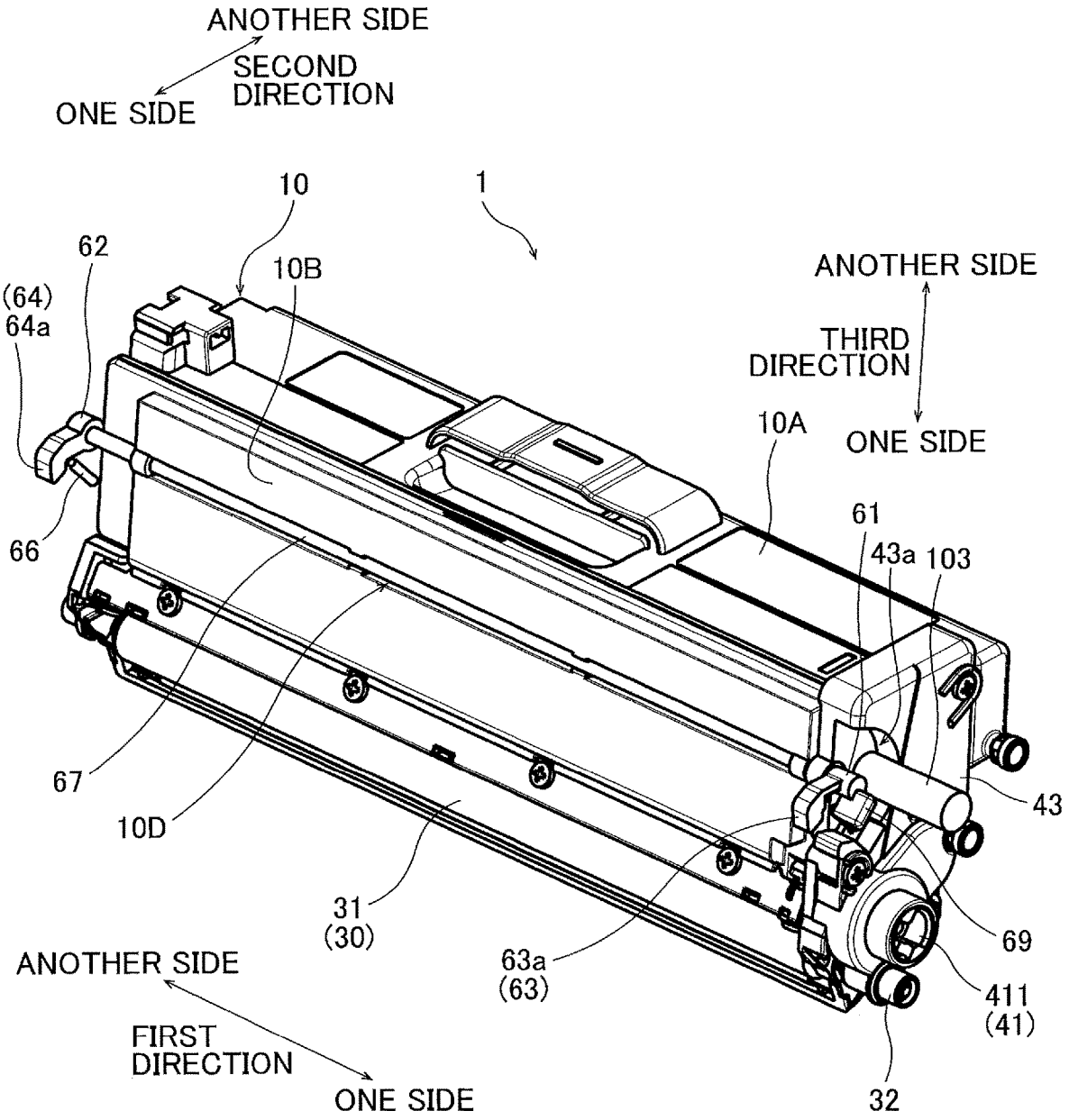
FIG. 9 is a perspective view of the developing cartridge according to the embodiment in a separated state of the image forming apparatus.
Figure 10:
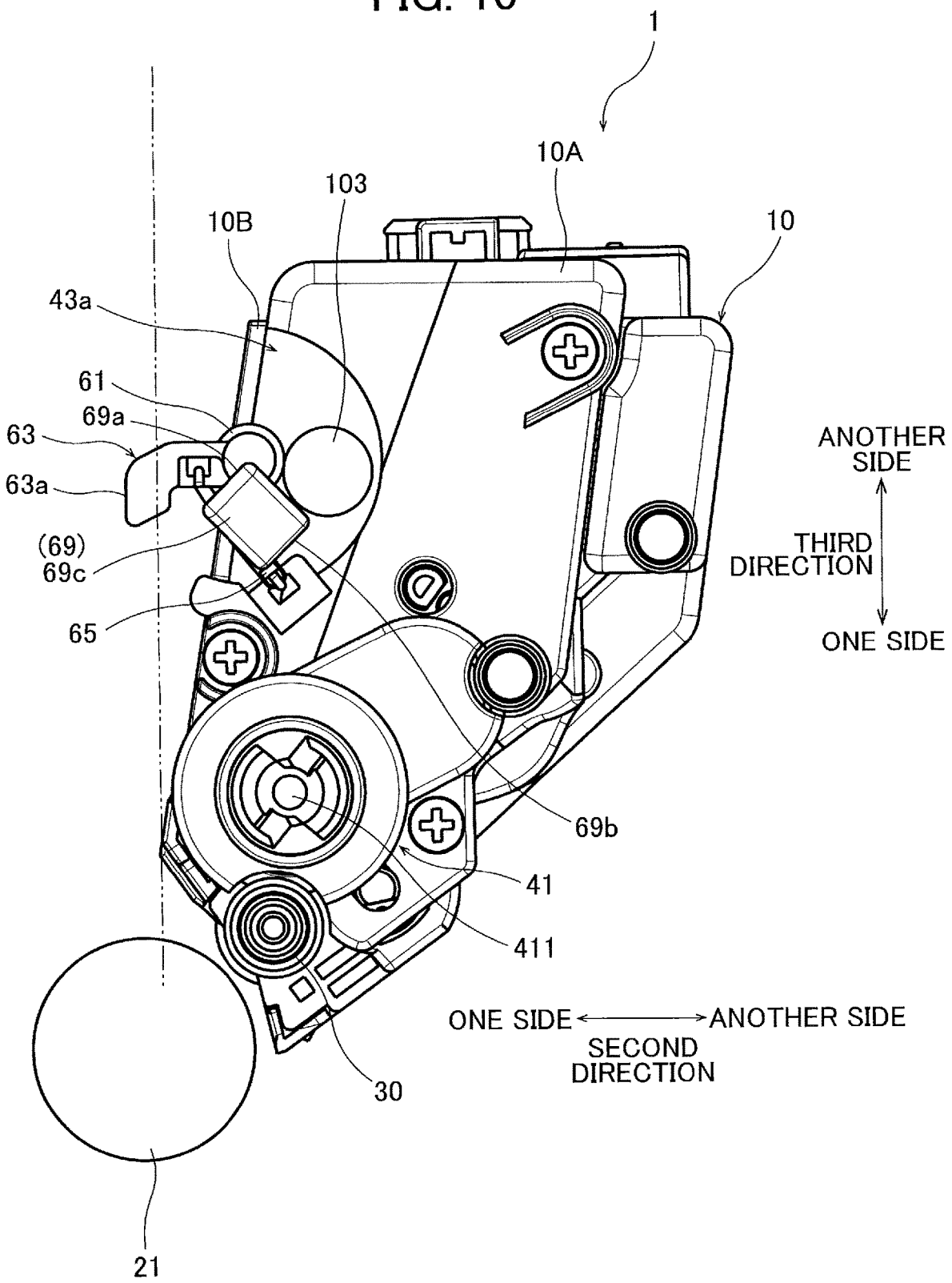
FIG. 10 is a view of the developing cartridge according to the embodiment and the photosensitive drum of the drum cartridge in the separated state of the image forming apparatus as viewed in the first direction from the one side toward the other side.

FIG. 7 is a perspective view of the developing cartridge 1 in the contacting state of the image forming apparatus 100. FIG. 8 is a view of the developing cartridge 1 and the photosensitive drum 21 in the contacting state of the image forming apparatus 100 as viewed in the first direction from the one side toward the other side. FIG. 9 is a perspective view of the developing cartridge 1 in the separated state of the image forming apparatus 100. FIG. 10 is a view of the developing cartridge 1 and the photosensitive drum 21 in the separated state of the image forming apparatus 100 as viewed in the first direction from the one side toward the other side.

In the image forming apparatus 100, when the drive shaft 103 is driven to move toward the advanced position from the one side to the other side in the first direction of the casing 10, the drive shaft 103 contacts the pressure contact surface 69*c* of the cam 69 to press the pressure contact surface 69*c*. Through this contact between the drive shaft 103 and the pressure contact surface 69*c*, a pressing force applied by the drive shaft 103 to the pressure contact surface 69*c* is converted into a rotational force in a clockwise direction centered on the rotational axis A, whereby the cam 69 pivotally moves about the rotational axis A in the clockwise direction as viewed in the first direction from the one side toward the other side. In accordance with the pivotal movement of the cam 69, the first shaft 61 also rotates about the rotational axis A, and the first arm 63 also pivotally moves about the rotational axis A. As a result, the first arm 63 pivotally moves from the first position (see FIGS. 7 and 8) to the second position (see FIGS. 9 and 10). At this time, the second arm 64 also pivotally moves from the third position to the fourth position since the second arm 64 is connected to the first arm 63 through the connection bar 67.

During pivotal movement of the first arm 63 from the first position to the second position, the first arm 63 is brought into contact with the outer circumferential surface 240 of the first guide roller 24 of the drum cartridge 2. Further, during pivotal movement of the second arm 64 from the third position to the fourth position, the second arm 64 is brought into contact with the outer circumferential surface 250 of the second guide roller 25 of the drum cartridge 2.

As described above, the protruding amount of the first arm 63 from the third outer surface 13 becomes greater as the first arm 63 moves from the first position toward the second position (refer to FIGS. 8 and 10). Similarly, the protruding amount of the second arm 64 from the third outer surface 13 becomes greater as the second arm 64 moves from the third position toward the fourth position. Hence, the first arm 63 and the second arm 64 are urged by the first guide roller 24 and the second guide roller 25, respectively, to move the developing cartridge 1 in the second direction from the one side toward the other side, thereby causing the developing roller 30 to move away from the photosensitive drum 21.

That is, in the state where the developing cartridge 1 is attached to the drum cartridge 2, the developing roller 30 separates from the photosensitive drum 21 in the second direction when the first arm 63 pivotally moves from the first position to the second position and the second arm 64 pivotally moves from the third position to the fourth position. Specifically, the developing roller 30 is in contact with the photosensitive drum 21 when the first arm 63 is at the first position and the second arm 64 is at the fourth position. On the other hand, the developing roller 30 is in separation from the photosensitive drum 21 when the first arm 63 is at the second position the second arm 64 is at the fourth position.

More specifically, the flat surface 63*a* of the first arm 63 is positioned to extend approximately parallel to the third direction upon the pivotal movement of the first arm 63 to the second position. Hence, the flat surface 63*a* of the first arm 63 is brought into contact with the outer circumferential surface 240 of the first guide roller 24. Simultaneously, the flat surface 64*a* of the second arm 64 is positioned to extend approximately parallel to the third direction upon the pivotal movement of the second arm 64 to the fourth position. Hence, the flat surface 64*a* of the second arm 64 is brought into contact with the outer circumferential surface 250 of the second guide roller 25. Owing to the contact between the flat surface 63*a* and the outer circumferential surface 240 and the contact between the flat surface 64*a* and the outer circumferential surface 250, stabilized movement of the developing roller 30 in a direction away from the photosensitive drum 21 in the second direction can be realized.

In a case where there needs to make the developing roller 30 and the photosensitive drum 21 to contact each other again after the developing roller 30 and the photosensitive drum 21 are once separated, the drive shaft 103 moves back to its retracted position from the other side in the first direction of the casing 10 toward the one side in the first direction of the casing 10. In accordance with movement of the drive shaft 103, the first arm 63 pivotally moves from the second position to the first position due to the urging force of the first elastic member 65. At this time, the first shaft 61 also rotates and the cam 69 also pivotally moves along with the pivotal movement of the first arm 63. Similarly, the second arm 64 pivotally moves from the fourth position to the third position by the urging force of the second elastic member 66.

In the meantime, the frame 200 of the drum cartridge 2 further includes an urging mechanism (not illustrated) for urging the casing 10 toward the photosensitive drum 21. The urging mechanism urges the casing 10 in the second direction from the other side toward the one side, whereby the developing roller 30 and the photosensitive drum 21 are again brought into contact with each other. Switching between the contacting state and the separated state can be realized in the image forming apparatus 100 in this way.

<6. Summary>

As described above, the developing cartridge 1 according to the present embodiment includes the casing 10, the developing roller 30, the first shaft 61, the first arm 63, and the cam 69. The cam 69 has the pressure contact surface 69*c*. In the above developing cartridge 1, when a pressing force is applied to the pressure contact surface 69*c* of the cam 69, the first arm 63 pivotally moves from the first position (see FIGS. 7 and 8) to the second position (see FIGS. 9 and 10) along with the rotation of the first shaft 61 and the pivotal movement of the cam 69. As such, application of a pressing force to the pressure contact surface 69*c* can pivotally move the first arm 63 along with the rotation of the first shaft 61 and the pivotal movement of the cam 69.

Further, during the pivotal movement of the first arm 63 from the first position to the second position, the first arm 63 is urged by the outer circumferential surface (contact surface) 240 of the first guide roller 24 of the drum cartridge 2. With this configuration, the developing roller 30 can move away from the photosensitive drum 21.

As such, in the developing cartridge 1 according to the present embodiment, the separation of the developing roller 30 from the photosensitive drum 21 can be performed by a driving force applied only to the one side in the first direction of the developing cartridge 1. Application of a driving force to both sides in the first direction of the developing cartridge 1 is unnecessary.

Further, in the present embodiment, the main body portion 9 includes the drive shaft 103 (see FIGS. 7 through 10). The first arm 63 pivotally moves from the first position to the second position when the drive shaft 103 presses the pressure contact surface 69*c* of the developing cartridge 1 according to the present embodiment. That is, the developing roller 30 can separate from the photosensitive drum 21 by the driving force applied from the main body portion 9.

Further, the developing cartridge 1 according to the present embodiment includes the first elastic member 65. Accordingly, when a pressing force is not applied to the pressure contact surface 69*c* after the first arm 63 pivotally moves from the first position to the second position by the pressing force applied to the pressure contact surface 69*c*, the first arm 63 can move back from the second position to the first position by the urging force of the first elastic member 65.

Further, in the developing cartridge 1 according to the present embodiment, the first elastic member 65 is a tension spring. Hence, when the first arm 63 pivotally moves from the first position to the second position and then the pressure contact surface 69*c* is released from a pressing force, the first arm 63 can return to the first position due to a tensile force of the tension spring.

Further, in the developing cartridge 1 according to the present embodiment, the pressure contact surface 69*c* is inclined so as to approach the casing 10 as extending away from the first arm 63. Accordingly, when a pressing force directed from the one side in the first direction of the casing 10 to the other side in the first direction of the casing 10 is applied by the drive shaft 103 to the pressure contact surface 69*c*, the pressing force is converted into a rotational force centered on the rotational axis A through the contact between the drive shaft 103 and the pressure contact surface 69*c*. Hence, the first arm 63 can pivotally move from the first position to the second position to thereby separate the developing roller 30 from the photosensitive drum 21.

Further, in the developing cartridge 1 according to the present embodiment, the distal end portion of the first arm 63 has the flat surface 63*a* extending in parallel to the first direction. With this configuration, when the first arm 63 pivotally moves to the second position, a broader contacting area between the flat surface 63*a* of the first arm 63 and the outer circumferential surface 240 of the first guide roller 24 can be obtained, whereby the casing 10 and the developing roller 30 can stably move in the direction away from the photosensitive drum 21 in the second direction.

Further, the developing cartridge 1 according to the present embodiment includes the developing roller gear, the coupling 41, and the gear cover 43. The gear cover 43 has the notch 43*a*. The first shaft 61, the first arm 63, the cam 69, and at least a portion of the first elastic member 65 are positioned inside the notch 43*a*.

Further, in the developing cartridge 1 according to the present embodiment, the one end of the first elastic member 65 is connected to the first arm 63, and the other end of the first elastic member 65 is connected to the inner edge of the notch 43*a*. By making use of the inner edge of the notch 43*a* in this way, positioning of the first elastic member 65 while avoiding interference with the first outer surface 11 of the casing 10 can be easily realized.

Further, in the developing cartridge 1 according to the present embodiment, the first arm 63 and the first elastic member 65 are positioned between the first outer surface 11 of the casing 10 and the cam 69 in the first direction. Further, when the first arm 63 is at the first position, at least a portion of the cam 69 does not overlap the first elastic member 65 in the first direction. On the other hand, at least a portion of the cam 69 overlaps the first elastic member 65 in the first direction when the first arm 63 is at the second position. With this configuration, a space for layout of the first arm 63, the cam 69, and the first elastic member 65 can be reduced.

Further, the developing cartridge 1 according to the present embodiment includes the second shaft 62 and the second arm 64. Due to the application of the pressing force to the pressure contact surface 69*c*, the second arm 64 pivotally moves from the third position to the fourth position in interlocking relation to the pivotal movement of the first arm 63. Since the first arm 63 is positioned at the one end portion in the first direction of the casing 10 and the second arm 64 is positioned at the other end portion in the first direction of the casing 10, the components at the one end portion and the other end portion in the first direction of the casing 10 can be urged by the outer circumferential surfaces 240 and 250 of the pair of guide rollers (first and second guide rollers 24 and 25), respectively. Accordingly, the developing roller 30 can reliably separate from the photosensitive drum 21 while avoiding inclination of the developing cartridge 1.

Further, in the developing cartridge 1 according to the present embodiment, the casing 10 has the groove 10D extending in the first direction. At least a portion of the connection bar 67 is positioned inside the groove 10D. Hence, the casing 10 can rotatably support the connection bar 67 with a simple configuration.

Further, in the developing cartridge 1 according to the present embodiment, the groove 10D is positioned at the outer surface of the lid 10B. That is, machining the lid 10B for forming the groove 10D can be easily performed.

Further, the developing cartridge 1 according to the present embodiment includes not only the first elastic member 65 but also the second elastic member 66. With this configuration, the pivotal movement of the first arm 63 and the second arm 64 can be stably performed.

<7. Modifications>

While the description has been made in detail with reference to the specific embodiment, it would be apparent to those skilled in the art that various modifications can be made thereto.

In the above-described embodiment, the other end of the first elastic member 65 is connected to the inner edge of the gear cover 43 (i.e., the inner edge of the notch 43*a*). However, the other end of the first elastic member 65 may be connected to the outer surface of the casing instead.

The second elastic member 66 may be dispensed with.

In the above-described embodiment, the groove 10D is provided to extend over one end to another end in the first direction of the lid 10B. However, instead of the above configuration, the groove 10D may be intermittently provided along the first direction at the outer surface of the lid 10B. In other words, a portion of the connection bar 67 may be positioned within the groove 10D, and the remaining portion of the connection bar 67 may be positioned outside of the groove 10D.

An outer peripheral surface of the connection bar 67 may be in contact with an inner surface of the groove 10D, or may not be in contact with the inner surface of the groove 10D.

The first guide roller and the second guide roller may not be necessarily provided in the drum cartridge 2. In this case, the first arm may contact the frame of the drum cartridge when the first arm pivotally moves from the first position to the second position. Also, the second arm may contact the frame of the drum cartridge when the second arm pivotally moves from the third position to the fourth position.

Further, the detailed configuration and the shape of the developing cartridge may be suitably modified without departing from the scope of the present disclosure. Further, each component in the above-described embodiment and the above modifications may be suitably combined together avoiding conflicting combination.

What is claimed is:

1. A developing cartridge comprising:

a developing roller rotatable about a developing roller-axis extending in a first direction;

a casing configured to accommodate developing agent therein, the casing having an outer surface positioned at one end portion in the first direction of the casing;

a shaft positioned at the outer surface of the casing and rotatable about a rotational axis extending in the first direction, the shaft having an outer periphery;

an arm extending radially outward from the outer periphery of the shaft, the arm being pivotally movable about the rotational axis along with rotation of the shaft; and a cam extending radially outward from the outer periphery of the shaft in a direction different from a direction in which the arm extends, the cam being pivotally movable about the rotational axis along with the rotation of the shaft, the cam having:

one end connected to the shaft;

another end positioned farther from the rotational axis than the one end is farther from the rotational axis; and a pressure contact surface inclined so as to approach the outer surface of the casing as extending from the one end toward the another end, wherein, when a pressing force is applied to the pressure contact surface, the arm pivotally moves from a first position to a second position along with pivotal movement of the cam and along with the rotation of the shaft.

2. The developing cartridge according to claim 1, wherein the developing roller has an outer circumferential surface including one end portion and another end portion in a second direction crossing the first direction, the one end portion being exposed to an outside of the casing, the another end portion being positioned inside the casing.

3. The developing cartridge according to claim 2, wherein the developing cartridge is for use with a drum cartridge including a photosensitive drum, and wherein, in a state where the developing cartridge is attached to the drum cartridge, the developing roller separates from the photosensitive drum in the second direction in accordance with the pivotal movement of the arm from the first position to the second position.

4. The developing cartridge according to claim 3, wherein, when the arm is at the first position, the developing roller is in contact with the photosensitive drum, and wherein, when the arm is at the second position, the developing roller is in separation from the photosensitive drum.

5. The developing cartridge according to claim 3, wherein the casing further has another end portion spaced away from the one end portion in the first direction, and wherein, when the pressure contact surface receives a pressing force directed in a direction from the one end portion toward the another end portion in the first direction of the casing, the arm pivotally moves from the first position to the second position.

6. The developing cartridge according to claim 5, wherein the drum cartridge is attachable to a main body portion of an image forming apparatus in the state where the developing cartridge is attached to the drum cartridge, the main body portion including a drive shaft extending in the first direction, the drive shaft being movable in the first direction between an advanced position and a retracted position in response to receiving a driving force applied from the main body portion, the drive shaft being movable toward the advanced position in the direction from the one end portion toward the another end portion in the first direction of the casing to press the pressure contact surface, and wherein, when the drive shaft presses the pressure contact surface, the arm pivotally moves from the first position to the second position.

7. The developing cartridge according to claim 1, further comprising an elastic member urging the arm in a direction from the second position toward the first position.

8. The developing cartridge according to claim 7, wherein the elastic member is a tension spring.

9. The developing cartridge according to claim 7, further comprising:

a developing roller gear positioned at the outer surface of the casing and rotatable together with the developing roller;

a coupling rotatable about a coupling axis extending in the first direction and configured to transmit a driving force to the developing roller gear, the coupling having an outer periphery; and a gear cover covering at least a portion of each of the outer periphery of the coupling and the developing roller gear from one side in the first direction of the casing, the gear cover having a notch recessed toward one end portion thereof in the second direction, wherein the shaft, the arm, the cam, and at least a portion of the elastic member are positioned inside the notch.

10. The developing cartridge according to claim 9, wherein the elastic member has one end connected to the arm and another end connected to the outer surface of the casing.

11. The developing cartridge according to claim 9, wherein the elastic member has one end connected to the arm and another end connected to an inner edge of the notch.

12. The developing cartridge according to claim 11, wherein, when the arm is at the first position, the cam has a portion that does not overlap the elastic member in the first direction, and wherein, when the arm is at the second position, the cam has a portion overlapping the elastic member in the first direction.

13. The developing cartridge according to claim 7, wherein the arm and the first elastic member are positioned between the outer surface of the casing and the cam in the first direction.

14. The developing cartridge according to claim 1, wherein the pressure contact surface is inclined so as to approach the casing as extending away from the arm.

15. The developing cartridge according to claim 1, wherein the arm has a distal end portion having a flat surface extending in parallel to the first direction.

16. The developing cartridge according to claim 1, wherein the shaft is a first shaft, and the arm is a arm, and wherein the casing further has a second outer surface positioned at another end portion in the first direction of the casing, the developing cartridge further comprising:

a second shaft positioned at the second outer surface and rotatable about the rotational axis along with the rotation of the first shaft, the second shaft having an outer periphery; and a second arm extending radially outward from the outer periphery of the second shaft, the second arm being pivotally movable about the rotational axis along with rotation of the second shaft, wherein, when a pressing force is applied to the pressure contact surface, the second arm pivotally moves from a third position to a fourth position along with the rotation of the second shaft in accordance with the pivotal movement of the arm from the first position to the second position.

17. The developing cartridge according to claim 16, further comprising a connection bar extending in the first direction, the connection bar being positioned between the first shaft and the second shaft in the first direction and connecting the first shaft and the second shaft to each other, the connection bar being rotatable about the rotational axis along with the rotation of the first shaft and the second shaft.

18. The developing cartridge according to claim 17, wherein the connection bar has one end and another end in the first direction, wherein the first shaft is fixed to the one end in the first direction of the connection bar, and wherein the second shaft is fixed to the another end in the first direction of the connection bar.

19. The developing cartridge according to claim 17, wherein the casing further has a third outer surface positioned at one end portion in the second direction of the casing, and wherein the connection bar is rotatably supported by the third outer surface of the casing.

20. The developing cartridge according to claim 19, wherein the casing further has a groove positioned at the third outer surface and extending in the first direction, and wherein the connection bar has a portion positioned inside the groove.

21. The developing cartridge according to claim 20, wherein the casing includes a frame having a flat plate shape and positioned at the one end portion in the second direction of the casing, the frame having an outer surface, and wherein the groove is positioned at the outer surface of the frame.

22. The developing cartridge according to claim 17, comprising an elastic member positioned at the second outer surface of the casing, the elastic member urging the second arm in a direction from the fourth position toward the third position.

* * * * *